US007303346B2

(12) United States Patent
Ogi et al.

(10) Patent No.: US 7,303,346 B2
(45) Date of Patent: Dec. 4, 2007

(54) IMAGE-FORMING APPARATUS, FRAME STRUCTURE USED THEREIN AND METHOD FOR PRODUCING THE FRAME STRUCTURE

(75) Inventors: Satoshi Ogi, Saitama (JP); Hideki Matsumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/654,921

(22) Filed: Sep. 5, 2003

(65) Prior Publication Data

US 2004/0130700 A1 Jul. 8, 2004

(30) Foreign Application Priority Data

Nov. 26, 2002 (JP) ..... P2002-342653

(51) Int. Cl.
*B41J 11/60* (2006.01)
*B41J 29/02* (2006.01)

(52) U.S. Cl. ..... 400/693; 400/691; 399/116

(58) Field of Classification Search ..... 400/691, 400/692, 693; 399/110, 113, 116, 117
See application file for complete search history.

(56) References Cited

U.S. PATENT DOCUMENTS 5,809,377 A * 9/1998 Chiesa et al. ..... 399/111
6,685,371 B1 * 2/2004 Holmberg ..... 400/692
6,789,892 B2 * 9/2004 Hetzer et al. ..... 347/108
7,033,096 B2 * 4/2006 Hetzer et al. ..... 400/663
2001/0026724 A1 * 10/2001 Endo et al. ..... 400/691

FOREIGN PATENT DOCUMENTS

JP 6-317954 11/1994
JP 9-222843 8/1997
JP 2002-185154 6/2002

* cited by examiner

*Primary Examiner*—Ren Yan
(74) *Attorney, Agent, or Firm*—Morgan, Lewis & Bockius LLP

(57) ABSTRACT

An image-forming apparatus provided with an image-forming portion in a casing, including: a casing frame forming a skeleton of the casing; a shield chassis portion formed so as to be partially integrated with the casing frame per se; and at least one board directly attached to the shield chassis portion and mounted with a power supply circuit, a control circuit and an image-processing circuit for permitting the image-forming portion to execute an image-forming process. A frame structure per se of the image-forming apparatus (an embodiment in which the shield chassis portion is formed so as to be integrated with the casing frame per se) or a method for producing the frame structure is also a subject of the invention.

13 Claims, 12 Drawing Sheets

IMAGE-FORMING APPARATUS, FRAME STRUCTURE USED THEREIN AND METHOD FOR PRODUCING THE FRAME STRUCTURE

CROSS REFERENCE OF RELATED APPLICATION

This application is based on and claims priority under 35 U.S.C. §119 with respect to Japanese Patent Application No. 2002-342653 filed on Nov. 26, 2002, the entire content of which is incorporated herein by reference.

BACKGROUND OF THE INVENTION

1. Field of the Invention

The present invention relates to an image-forming apparatus such as a copying machine or a printer and particularly to an image-forming apparatus improved in a mounting structure of main circuit boards for permitting an image-forming portion to execute an image-forming process, a frame structure used in the image-forming apparatus and a method for producing the frame structure.

2. Description of the Related Art

Generally, an image-forming apparatus such as a copying machine or a printer has an image-forming portion in a casing. To permit the image-forming portion to execute an image-forming process, it is necessary to mount a main circuit board mounted with main circuits such as a power supply circuit, a control circuit and an image-processing circuit.

As a mounting structure of this type main circuit board in the related art, the main circuit board has been mounted to a casing frame forming a skeleton of the casing, through a shield chassis for an EMI (Electromagnetic Interference) countermeasure (e.g., see Documents 1 to 3).

In this case, for example, a metal plate shaped like a box has been used as the shield chassis.

[Document 1]

JP-A-2002-185154

[Document 2]

JP-A-9-222843

[Document 3]

JP-A-6-317954

In this type mounting structure of the main circuit board, it is necessary to connect the shield chassis to the casing frame to thereby connect the shield chassis to the ground. If the connection between the shield chassis and the casing frame is insufficient, the ground connection of the shield chassis is spoiled to thereby bring about fear that the effect of the EMI countermeasure cannot be fulfilled satisfactorily.

In addition, because the main board having the shield chassis needs to be mounted in the internal space surrounded by the casing frame, it is necessary to provide a space and fittings for mounting the shield chassis to thereby bring about fear that this may be a barrier to reduction in size and cost of the apparatus.

SUMMARY OF THE INVENTION

The invention is developed to solve the technical problems and an object of the invention is to provide an image-forming apparatus in which an EMI countermeasure can be achieved easily and surely, and a frame structure used in the image-forming apparatus.

That is, as shown in FIG. 1, the invention provides an image-forming apparatus provided with an image-forming portion in a casing, including: a casing frame 1 forming a skeleton of the casing; a shield chassis portion 2 formed so as to be partially integrated with the casing frame 1 per se; and at least one board 6 (e.g., 6*a*, 6*b*) attached to the shield chassis portion 2 and mounted with a power supply circuit 3, a control circuit 4 and an image-processing circuit 5 for permitting the image-forming portion to execute an image-forming process.

In this technical means, the term "casing" means a casing including the image-forming portion and made of a casing frame 1 provided with an exterior cover.

The configuration (such as a shape, a combination of frame elements, etc.) of the casing frame 1 maybe selected suitably.

The shield chassis portion 2 may be selected suitably if it has the same function (a chassis function as a base frame and an electromagnetic shielding function) as that of a separate shield chassis provided in the related art.

Here, the phrase "shield chassis portion 2 formed so as to be partially integrated with the casing frame 1 per se" means the gist that the invention does not include an embodiment in which a separate shield chassis is detachably attached to the casing frame 1.

Accordingly, as for the shield chassis portion 2, it is matter of course that the invention includes an embodiment in which the casing frame 1 per se is bent to thereby form the shield chassis portion 2 integrated with the casing frame 1. The invention further includes an embodiment in which the shield chassis portion 2 provided as a separate member is integrally welded with the casing frame 1, and an embodiment in which the casing frame 1 per se is used as part (e.g., a base portion) of the shield chassis portion 2 while the other part (e.g., shield walls 7 which will be described later) of the shield chassis portion 2 is detachably attached through fittings such as screws.

Three circuits such as a power supply circuit 3, a control circuit 4 and an image-processing circuit 5, which are main circuits for permitting the image-forming portion to execute an image-forming process, are used as circuits mounted in the board 6. If the board is a small board for a sensor circuit, the three circuits may be mounted in any positions of the board.

The term "at least one board" means the gist that the invention includes an embodiment in which boards are provided according to the three main circuits 3 to 5, and an embodiment in which any two of the three circuits 3 to 5 are mounted in one board 6.

As a method for mounting the main circuit board 6 on the shield chassis portion 2, the main circuit board 6 may be mounted on the shield chassis portion 2 directly by fittings such as screws or through brackets, spacers, washers, etc.

Because the board 6 is mounted on the shield chassis 2 of the casing frame 1 in this manner, the ground connection of the shield chassis portion 2 can be ensured without use of any separate shield chassis. This is effective in an EMI countermeasure.

In a typical embodiment of the shield chassis portion 2, shield walls 7 are provided so as to be erected from all or part of the circumference of a corresponding region of the casing frame 1 to thereby shape the shield chassis portion 2 like approximately a box.

Here, the phrase "shield walls 7 are provided so as to be erected from all or part of the circumference" is based on the fact that it is necessary to form an opening or a notch in the shield chassis portion 2 when a structure of connection between the board 6 and a harness is used.

Accordingly, in an embodiment in which the shield walls 7 are erected from all of the circumference of the corresponding region, an opening or a notch may be provided in a required place or part of the shield walls 7 may be erected so that an opening or a notch is formed in advance.

From the point of view of keeping the shielding effect more surely in the shield chassis portion 2, the shield chassis portion 2 may be preferably covered with a shield cover portion 8 in the condition that the board 6 is received in the shield chassis portion 2.

In this case, the shield cover portion 8 is selected suitably if it can basically block the opening in the shield chassis portion 2. The shield cover portion 8 may be provided with at least one shield wall not shown for partitioning the shield chassis portion 2.

According to this embodiment, the shield chassis portion 2 can be partitioned into a plurality of regions, so that the main circuits 3 to 5 can be disposed so as to be divided suitably while the shielding effects on the partitioned regions are kept good.

The shield chassis portion 2 may be set in an arbitrary place if the place is in the casing frame 1. From the point of view of effective use of the internal space in the casing frame 1, the shield chassis portion 2 is preferably formed in an outer side surface of the casing frame 1.

From the point of view of keeping the heat-radiating effect of the board 6, air holes 9 are preferably provided in part of the shield chassis portion 2.

Here the air holes 9 may be formed in arbitrary positions. From the point of view of a current of air, the air holes 9 are preferably formed in the upper side of the shield chassis portion 2 with respect to the position where the board 6 is disposed.

The frame element of the casing frame 1 used for forming the shield chassis portion 2 may have only the function of the shield chassis portion 2 or may also include another function.

For example, a member for supporting the sheet carrying path member may be included as another function.

That is, in this case, the casing frame 1 is formed so that at least part of the shield chassis portion 2 is integrated with the casing frame 1, and the casing frame 1 has a frame element which serves also as a support member for supporting at least the sheet carrying path member.

According to this embodiment, it is unnecessary to provide any support member separately for supporting the sheet carrying path member, so that reduction in the number of parts contributes to reduction in size and cost of the apparatus.

In a typical embodiment of the casing frame 1, the casing frame 1 has a base frame 11, and one main frame or a plurality of main frames 12 erected from the outside of the sheet passing region S of the base frame 11, wherein a shield chassis portion 2 is formed in at least one of the main frame or main frames 12.

Here, the term "base frame 11" includes a frame generally disposed substantially horizontally, and a frame disposed substantially vertically.

According to this embodiment, because the shield chassis portion 2 is formed in the main frame 12 erected from the outside of the sheet passing region S, the board 6 can be disposed regardless of the sheet passing region S. Accordingly, the apparatus can easily cope with the change of a layout in the casing frame 1.

Incidentally, it is a matter of course that frame elements other than and the base frame 11 and the main frame 12, such as a sub-frame 13 for supporting a certain functional element, a support frame 14 for keeping the stiffness of the casing frame 1, etc., may be added to the casing frame 1.

Particularly in a typical embodiment in which a plurality of main frames 12 (e.g., 12*a* and 12*b*) are provided so as to be erected, the pair of main frames 12 may be disposed so as to be opposite to each other with respect to the sheet passing region S.

This embodiment is effective in the stiffness of the casing frame 1 and the space and workability for installation of the board 6.

In this embodiment, the distance between the pair of main frames 12 (12*a* and 12*b*) may be preferably set variably.

In this case, because the distance between the main frames 12 can be set variably, the sheet passing region can be changed easily according to the change of the kind of the machine.

Here, the term "set variably" includes various embodiments in which the distance between the main frames 12 can be set variably. Although an embodiment in which the base frame 11 is exchanged is generally adopted, the invention is not limited thereto. For example, a plurality of places for setting the main frames 12 may be provided in the base frame 11 in advance so that the main frames 12 can be disposed in any ones of the setting places.

In a preferred layout of boards 6, shield chassis portions 2 are formed in a pair of main frames 12 (12*a* and 12*b*) respectively so that a board 6*a* mounted with a power supply circuit 3 is received in the shield chassis portion 2 of one of the pair of main frames 12 (e.g., 12*a*) whereas a board 6*b* mounted with a control circuit 4 and an image-processing circuit 5 is received in the shield chassis portion 2 of the other main frame 12 (e.g., 12*b*).

According to this embodiment, because the power supply circuit board 6*a* and the other main circuit board 6*b* are disposed in the opposite main frames 12 respectively so as to be far from each other, noise emitted from the power supply circuit 3 can be preferably prevented from having influence on the control circuit 4 and the image-processing circuit 5.

In another preferable layout of boards 6, a drive source 15 for driving the image-forming portion is disposed in one of the pair of main frames 12 (e.g., 12*b*) whereas a board 6*a* mounted with at least a high-voltage power supply circuit (a high-voltage power supply circuit portion of the power supply circuit 3) is received in the shield chassis portion 2 of the other main frame 12 (e.g., 12*a*).

According to this embodiment, because the drive source 15 for driving the image-forming portion and the high-voltage power supply circuit board 6*a* are disposed in the opposite main frames 12 (12*a* and 12*b*) respectively so as to be far from each other, noise emitted from the high-voltage power supply circuit can be preferably prevented from having influence on the drive circuit 15 for driving the image-forming portion.

A subject of the invention is not limited to the image-forming apparatus. A frame structure per se used in the image-forming apparatus may be also a subject of the invention.

In this case, as shown in FIG. 1, the invention provides a frame structure of an image-forming apparatus provided with an image-forming portion in a casing, including: a casing frame 1 forming a skeleton of the casing; a shield chassis portion 2 formed so that at least part of the shield chassis portion 2 is integrated with the casing frame 1 per se; and at least one board 6 mounted in the shield chassis portion 2 and mounted with a power supply circuit 3, a control circuit 4 and an image-processing circuit 5 for permitting the image-forming portion to execute an image-forming process.

In an embodiment of the frame structure in which the casing frame 1 has a base frame 11, and a pair of main frames 12 erected from the outside of a sheet passing region S of the base frame 11 so as to be opposite to each other and in which at least part of shield chassis portions 2 are formed so as to be integrated with the pair of main frames 12, the following producing method is used preferably.

The producing method includes the steps of: disposing the pair of main frames 12 provided with the shield chassis portions 2 so as to be opposite to each other; keeping the distance between the pair of main frames 12 constant by a spacing jig; and connecting the pair of main frames 12 to each other by the base frame 11.

The use of this producing method is based on the fact that each of the main frames 12 as a single article has stiffness (e.g., the main frame 12 is shaped like a box by the shield chassis portion 2).

That is, because each of the main frames 12 as a single article has stiffness, the dimensional accuracy and stiffness of the casing frame 1 as a whole can be ensured, for example, by a simple operation of connecting the main frames 12 to each other by the plate-like base frame 11 after deciding the distance between the main frames 12 by a simple jig.

In this case, because the method does not depend on the dimensional accuracy of the base frame 11, the base frame 11 can be exchanged easily according to the change of the kind of the machine (e.g., from an A4-size machine to an A3-size machine).

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

The invention will be described below in detail on the basis of embodiments shown in the accompanying drawings.

Embodiment 1

Figure 1:
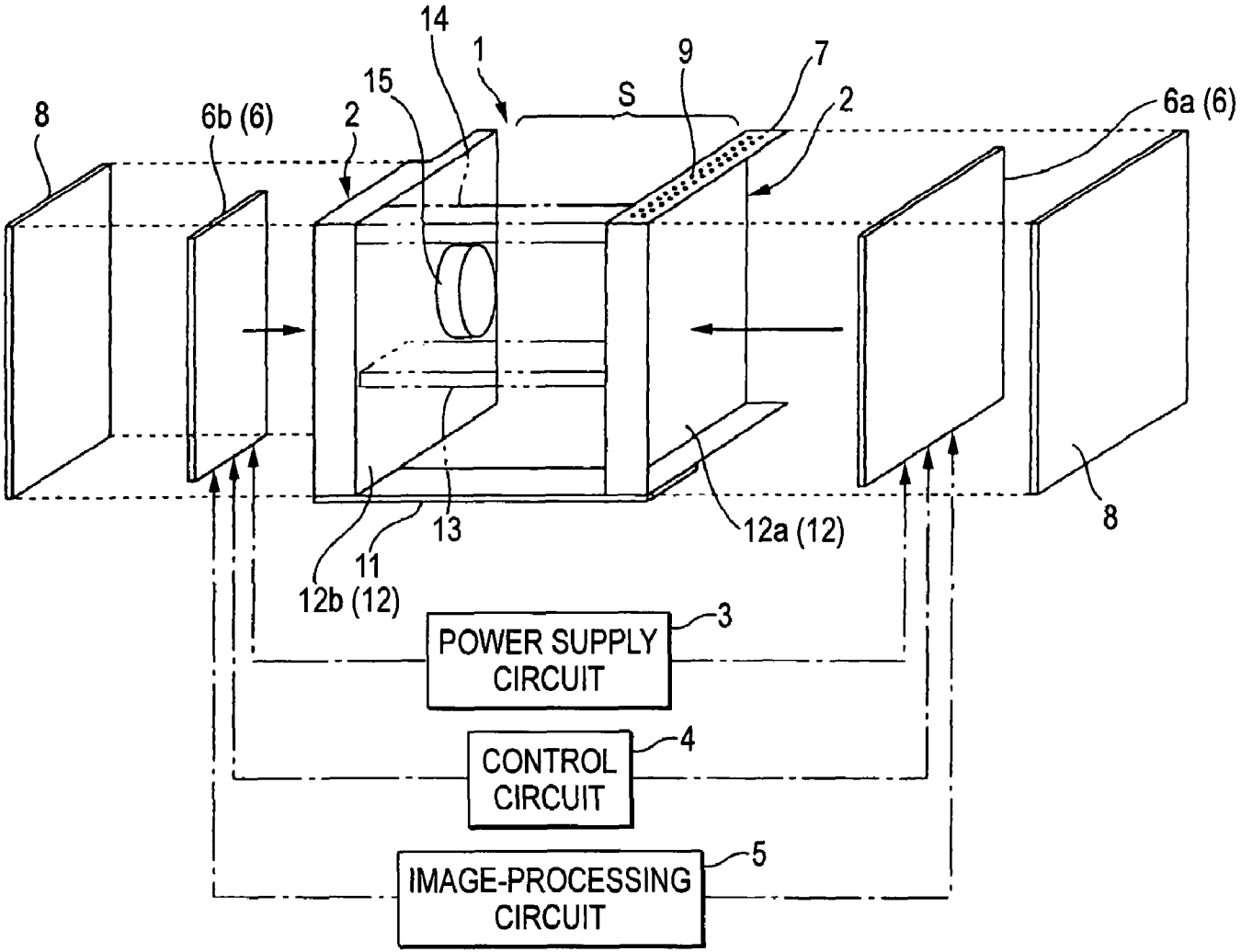
FIG. 1 is an explanatory view showing the outline of an image-forming apparatus according to the invention and a frame structure used in the image-forming apparatus.
Figure 2:
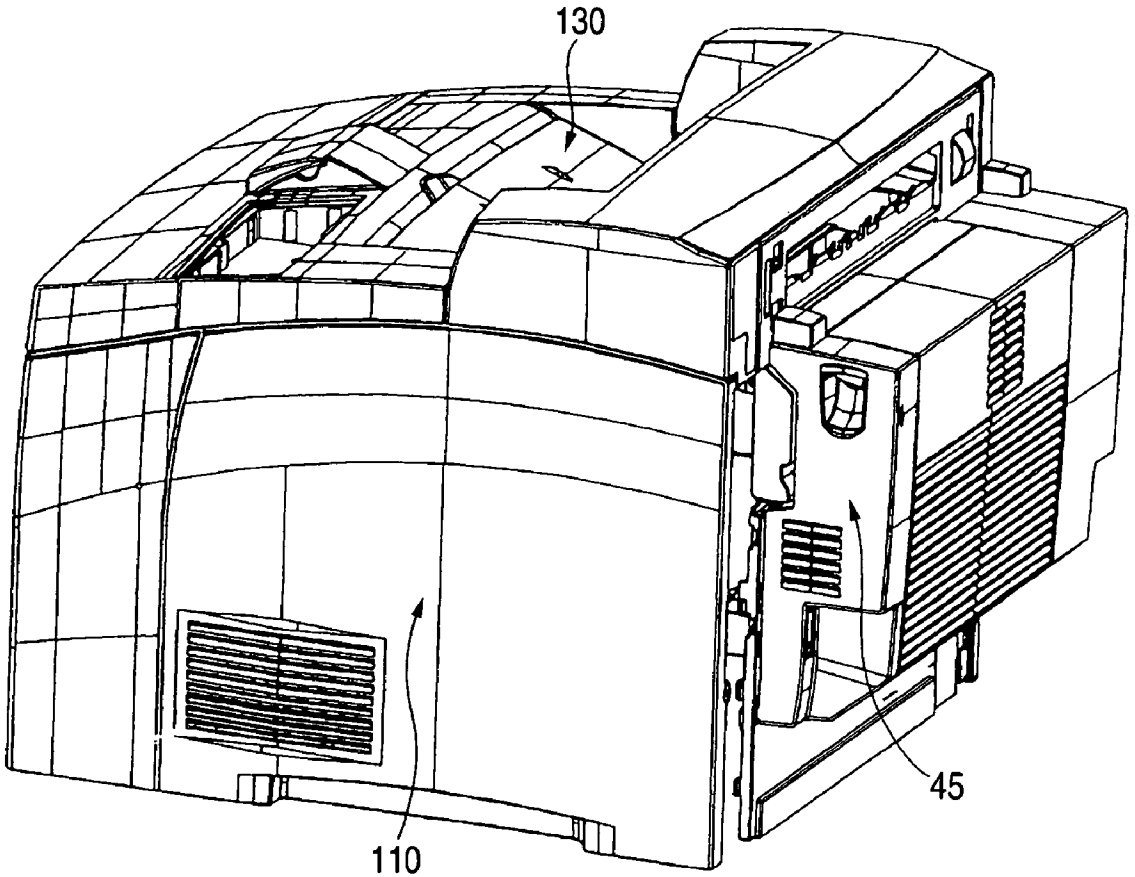
FIG. 2 is an explanatory view showing the external appearance of the image-forming apparatus according to Embodiment 1 of the invention.

FIG. 2 shows Embodiment 1 of an image-forming apparatus to which the invention is applied.

In FIG. 2, the image-forming apparatus is a monochrome printer capable of printing images on both surfaces of a sheet of paper. To make it possible to print images on both surfaces of a sheet of paper, a double-side recording unit 45 is added as an optional unit to a casing 110.

Incidentally, the term "casing 110" used in this embodiment means a combination of a casing frame 300 (which will be described later) and an exterior cover with which the casing frame 300 is covered.

Figure 3:
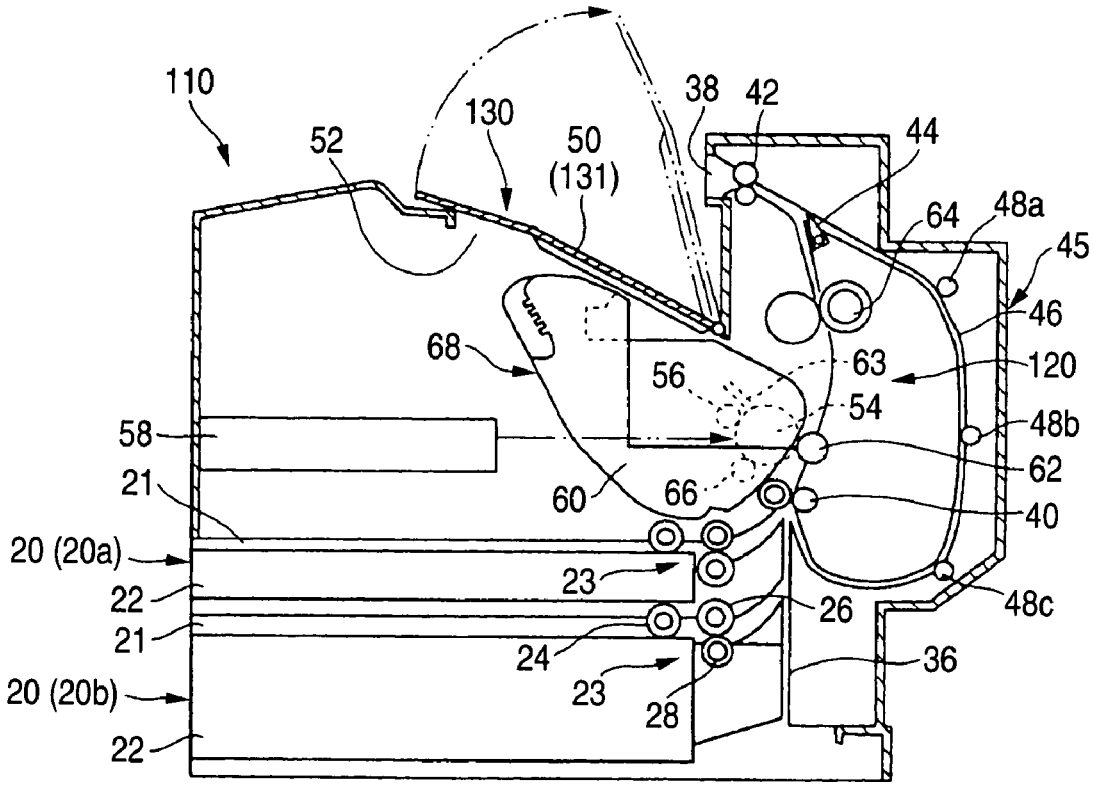
FIG. 3 is an explanatory view showing the overall configuration of the image-forming apparatus according to Embodiment 1.

As shown in FIGS. 2 and 3, in this embodiment, an image-forming portion 120 is mounted in the casing 110. A sheet ejection portion 130 for receiving ejected sheets is provided at a top portion of the casing 110. For example, two-stage sheet supply units 20 (specifically, 20*a* and 20*b*), which are units provided as standard equipment, are disposed in the lower portion of the casing 110 so as to be below the image-forming portion 120.

A sheet carrying path 36 for carrying a sheet supplied from each of the sheet supply units 20 (20*a* to 20*d*) is provided in the casing 110. The sheet carrying path 36 extends to an ejection hole 38 of the casing 110 after going through the image-forming portion 120.

Incidentally, when the apparatus system is to be extended, one-stage sheet supply unit or multi-stage sheet supply units (not shown) as an optional unit or optional units can be disposed, for example, under the casing 110.

For example, the image-forming portion 120 uses electrophotography. The image-forming portion 120 has: a photoconductor drum 54 as an image carrier; a charger 56, for example, made of a charge roll for electrically evenly charging the photoconductor drum 54; an exposure device 58 for optically writing an electrostatic latent image on the photoconductor drum 54 electrically charged by the charger 56; a developer 60 using developing agents for visualizing the latent image formed on the photoconductor drum 54 by the exposure device 58; a transfer device 62, for example, made of a transfer roll for transferring the developing agent image formed by the developer 60 onto a sheet of paper; a cleaning device 63, for example, made of a blade for cleaning the developing agents remaining on the photoconductor drum 54; and a fixing device 64, for example, made of a pair of a heating roll and a pressuring roll by which the developing agent image transferred onto the sheet by the transfer device 62 is fixed on the sheet.

In this embodiment, the exposure device 58 is, for example, constituted by a scanning type laser exposure device. The exposure device 58 is disposed in parallel to the sheet supply units 20 (20*a* and 20*b*) and near the front surface of the casing 110. Light emitted from the exposure device 58 goes across the developer 60 so that the photoconductor drum 54 is exposed to the light.

The developer 60 has a developing roll 66 facing the photoconductor drum 54.

In this embodiment, a process cartridge 68 formed in such a manner that a plurality of electrophotographic devices are integrated with one another is used. In this example, the photoconductor drum 54, the charger 56, the developer 60 and the cleaning device 63 are integrated as the process cartridge 68.

The sheet ejection portion 130 has an inclined portion 131 inclined to the casing 110. A top opening 52 is formed in the inclined portion 131. The top opening 52 is opened/closed by an opening/closing cover 50.

Here, the inclined portion 131 is inclined so as to be low at a portion corresponding to the ejection hole 38 but be gradually heightened frontward (rightward in FIG. 2). The opening/closing cover 50 is supported to the casing 110 so that the opening/closing cover 50 can rotate around the lower end of the inclined portion 131.

Particularly in this example, the process cartridge 68 is disposed right below the inclined portion 131 of the sheet ejection portion 130. The top opening 52 serves also as an opening for an operation of attaching/detaching the process cartridge 68. When the opening/closing cover 50 is opened, the process cartridge 68 is attached/detached through the top opening 52.

In this embodiment, the sheet carrying path 36 has a vertically carrying path extending substantially vertically on the rear side of the casing 110. Registration rolls 40 are provided on the upstream side of the photoconductor drum 54 in the vertically carrying path. Ejection rolls 42 are provided near the ejection hole 38. Incidentally, the photoconductor drum 54, the transfer device (transfer roll) 62 and the fixing device 64 located so as to face the sheet carrying path 36 serve also as carrying members.

Accordingly, the sheet supplied from any one of the sheet supply units 20 is temporarily stopped by the registration rolls 40 in the sheet carrying path 36 and carried to an image transfer position of the process cartridge 68 at predetermined timing so that an image is transferred onto the sheet. Then, the sheet passes through the fixing device 64 and is ejected to the sheet ejection portion 130 by the ejection rolls 42.

Incidentally, in the case of double-side printing, the sheet is returned to a reverse path 46 of a double-side recording unit 45.

That is, a portion which is in the sheet carrying path 36 and in front of the ejection rolls forks into two. A change-over gate 44 is provided at the two-forked portion. The reverse path 46 which returns from the two-forked portion to the registration rolls 40 is formed in the double-side recording unit 45.

A suitable number of carrying rolls 48 (e.g., 48*a* to 48*c*) are provided in the reverse path 46. In the case of double-side printing, the change-over gate 44 is switched to open the reverse path 46. The ejection rolls 42 rotate reversely at a point of time when a portion of the sheet in front of a rear end thereof passes through between the ejection rolls 42, so that the sheet is led to the reverse path 46. Then, the reversed sheet passes through between the registration rolls 40, between the photoconductor drum 54 and the transfer device 62 and the fixing device 64 and is ejected to the sheet ejection portion 130.

The sheet supply units 20 (20*a* and 20*b*) are basically identical in configuration. Of the sheet supply units 20*a* and 20*b* provided as standard equipment, the upper-stage sheet supply unit 20*a* has a sheet capacity selected to be smaller than that of the lower-stage sheet supply unit 20*b*.

As shown in FIG. 3, each of the sheet supply units 20 has a unit body 21, and a sheet cassette (sheet tray) 22 detachably attached to the unit body 21 and provided for receiving sheets.

The sheet cassette 22 is slidably attached to the unit body 21. In this example, the sheet cassette 22 is provided so as to be perfectly drawn out frontward (leftward in FIG. 3).

A feeder (sheet feed unit) 23 for feeding out a sheet from the sheet cassette 22 is provided on the rear side of the sheet supply unit 20. The feeder 23 has a nudger roll 24 for paying out sheets, a feed roll 26 provided on the sheet feed side of the nudger roll 24, and a retard roll 28 disposed to face the feed roll 26 for delivering sheets one by one.

Figure 4:
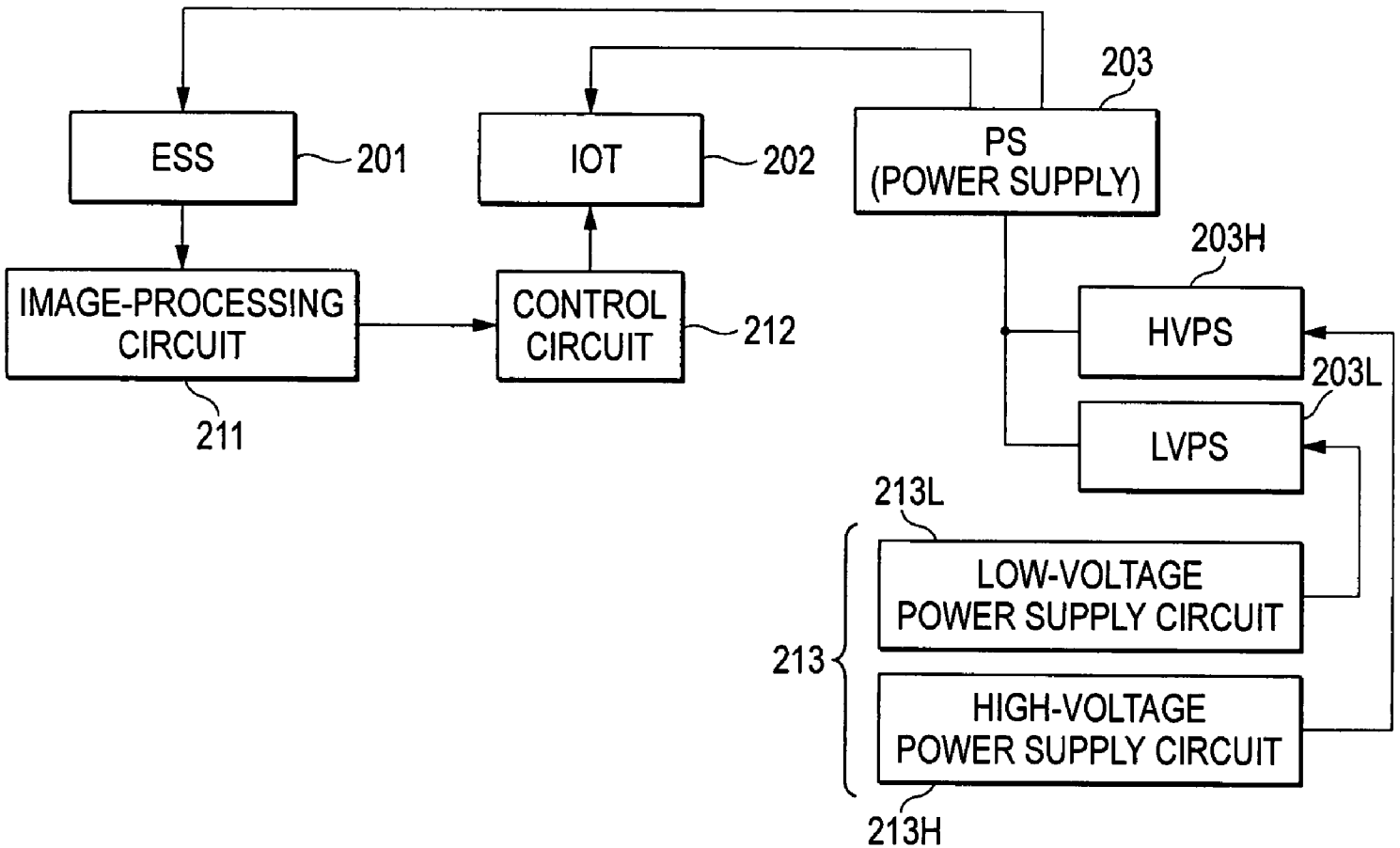
FIG. 4 is a typical view showing a system control system of the image-forming apparatus according to Embodiment 1.

FIG. 4 shows a system control system of the image-forming apparatus according to this embodiment.

In FIG. 4, the reference numeral 201 designates an electric sub-system (ESS) for generating image data on the basis of data read from an external recording medium, another computer or a scanner; 202, an image output terminal (IOT) having the image-forming unit 120 shown in FIG. 3, and a sheet carrying system; and 203, a power supply (PS) for supplying electric power to the ESS 201 and the IOT 202. Specifically, the PS 203 has a high-voltage power supply (HVPS) 203H, and a low-voltage power supply (LVPS) 203L.

In the configuration of the apparatus, image data from the ESS 201 is processed by an image-processing circuit 211 and then sent to a control circuit 212. The control circuit 212 sends a predetermined control signal to the ITO 202 so that an image-forming process can be carried out on the basis of the image data.

The power supply 203 (HVPS 203H and LVPS 203L) is controlled by a power supply circuit 213 (specifically, a high-voltage power supply circuit 213H and a low-voltage power supply circuit 213L).

The main circuits 211 to 213 are mounted in boards 250 (in this example, two boards 250*a* and 250*b*) which will be described later. The boards 250 are attached to a casing frame 300 (see FIG. 5) that forms a skeleton of the casing 110.

Particularly this embodiment has a special feature in the configuration of the casing frame 300 and the mount structure of the boards 250.

Figure 5:
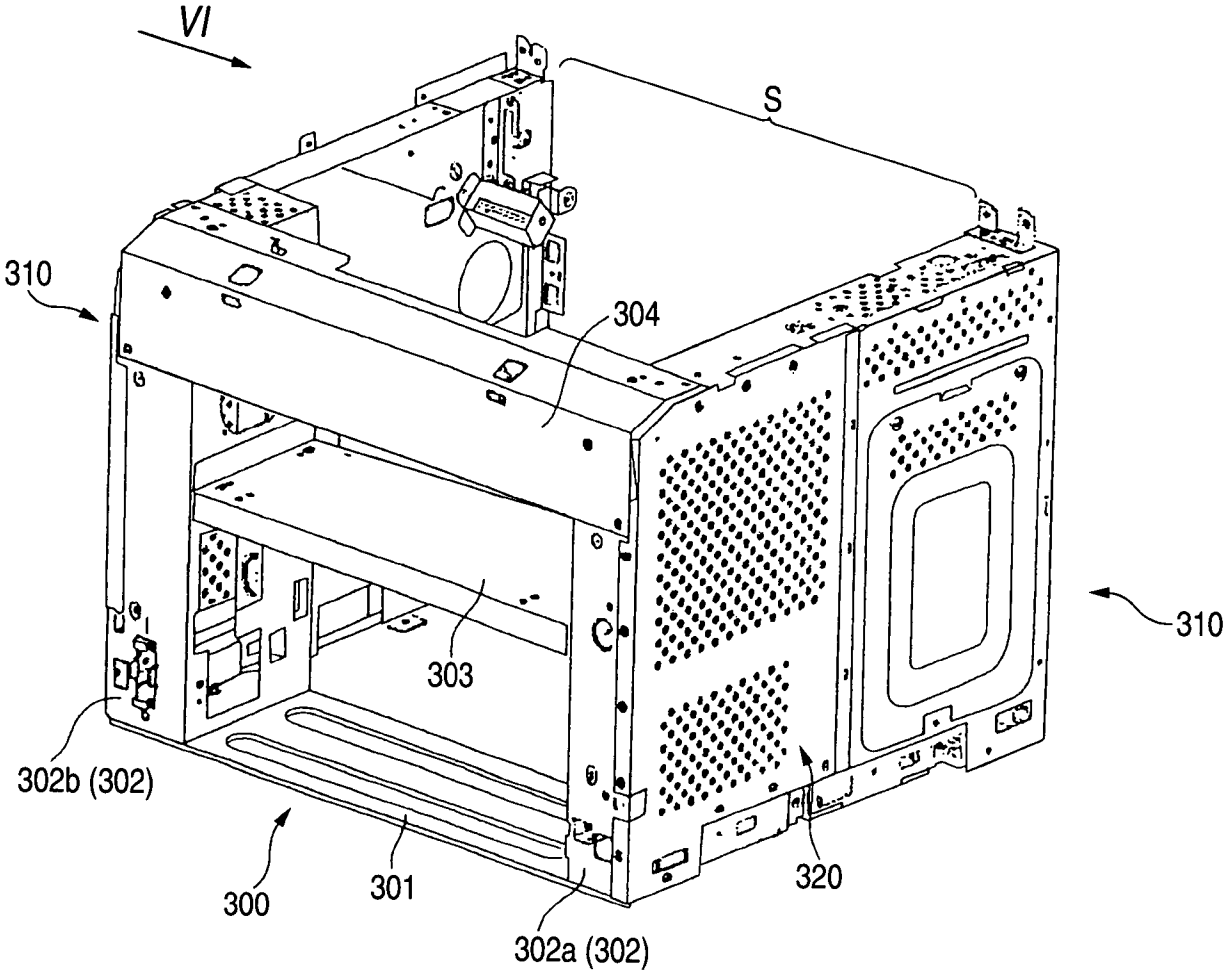
FIG. 5 is an explanatory view showing a frame structure according to Embodiment 1.
Figure 6:
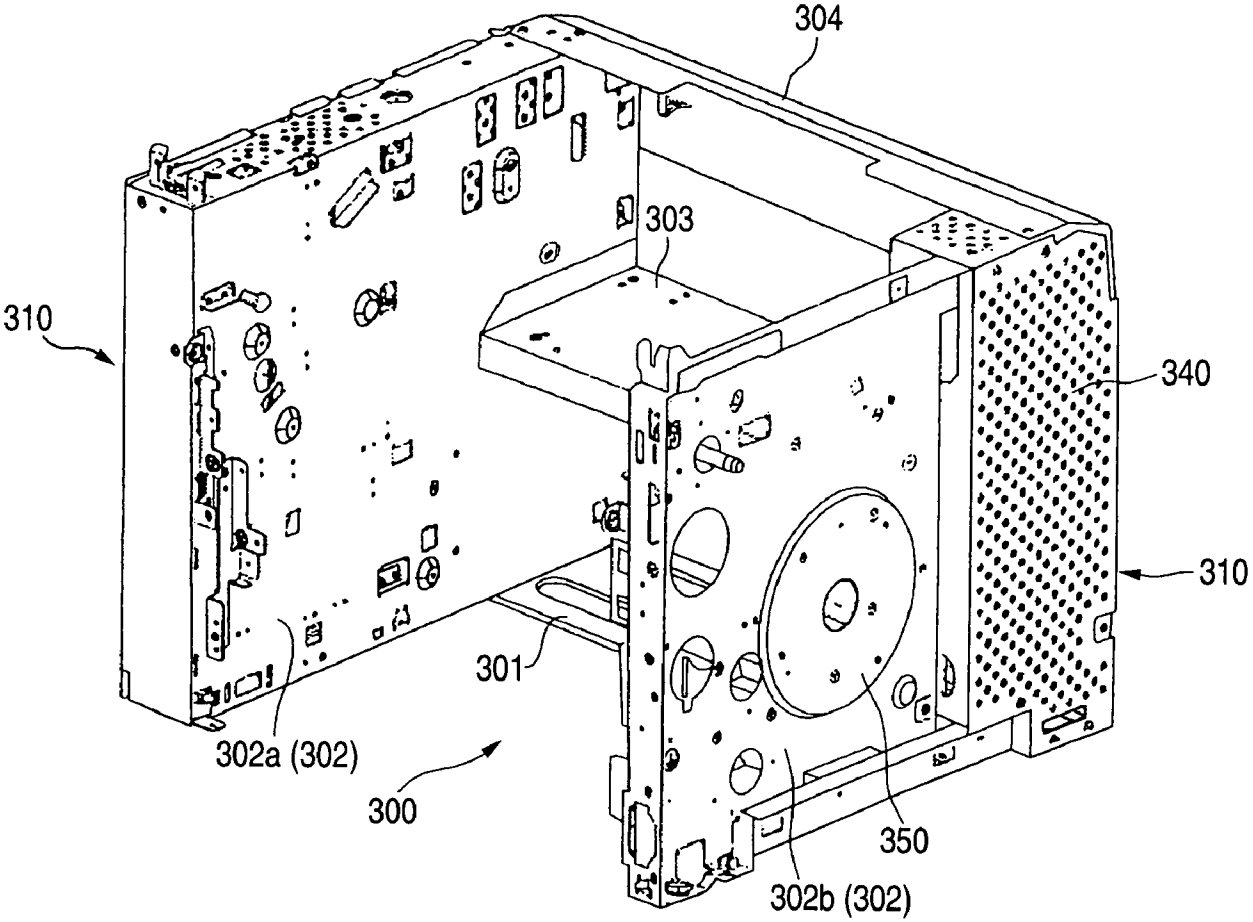
FIG. 6 is a view from the arrow VI in FIG. 5.

Specifically, as shown in FIGS. 5 and 6, the casing frame 300 has a plate-like base frame 301 disposed substantially horizontally, and a pair of main frames 302 (specifically, 302*a* and 302*b*) erected from the outside of a sheet passing region S of the base frame 301 so as to be opposite to each other.

In this example, a sub-frame 303 is provided in a predetermined position between the pair of main frames 302. For example, the sub-frame 303 is used as a member for supporting the exposure device 58 (see FIG. 3) of the image-forming portion 120.

From the point of view of ensuring the stiffness of the casing frame 300, a tie plate 304 which is a reinforcing support frame is provided between upper corner portions of the pair of main frames 302.

For example, each of these frames 301 to 304 is formed of a zinc-plated steel plate.

Figure 11:
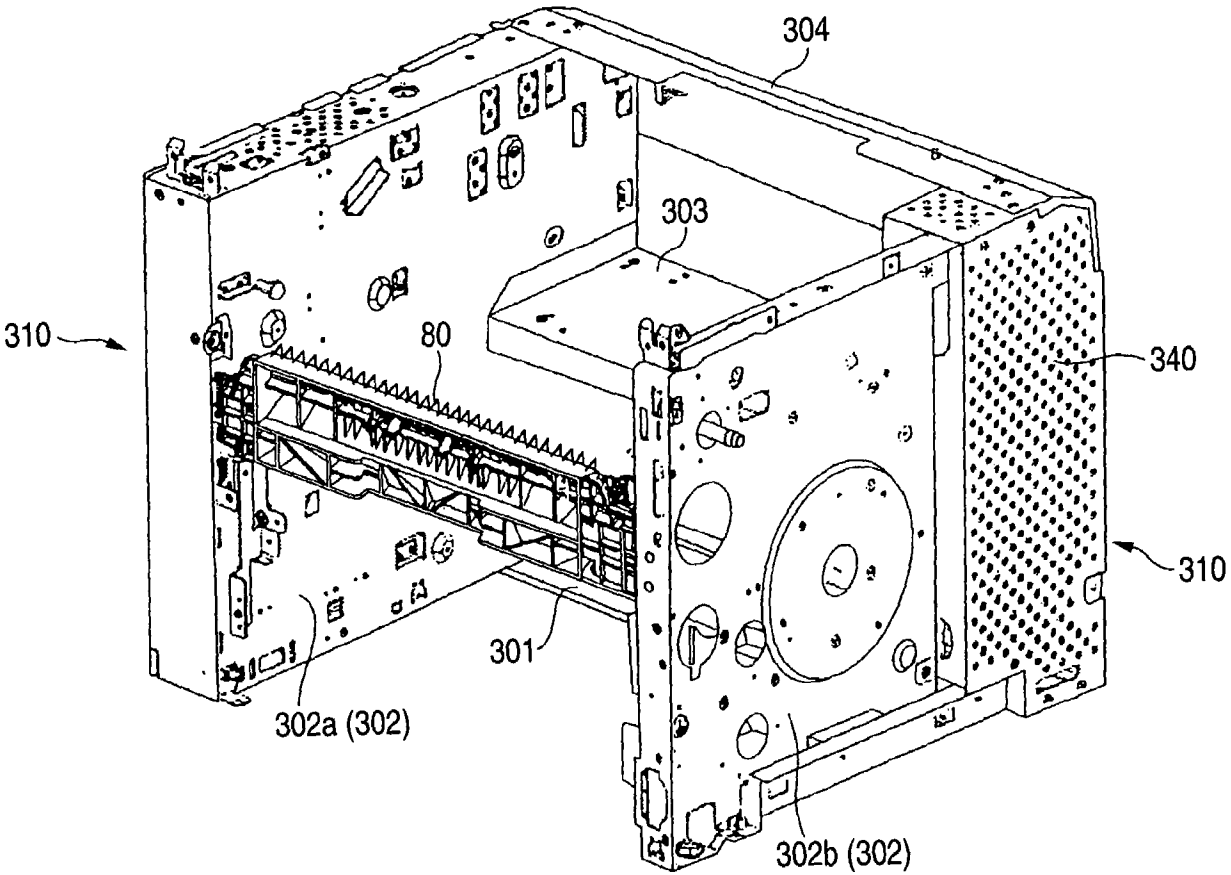
FIG. 11 is an explanatory view showing the relation between the frame structure according to Embodiment 1 and a sheet carrying path member.

In this embodiment, for example, as shown in FIG. 11, the pair of main frames 302 serve also as members for supporting a sheet carrying path member (such as a shoot frame) 80 forming the sheet carrying path 36 (see FIG. 3).

Figure 7:
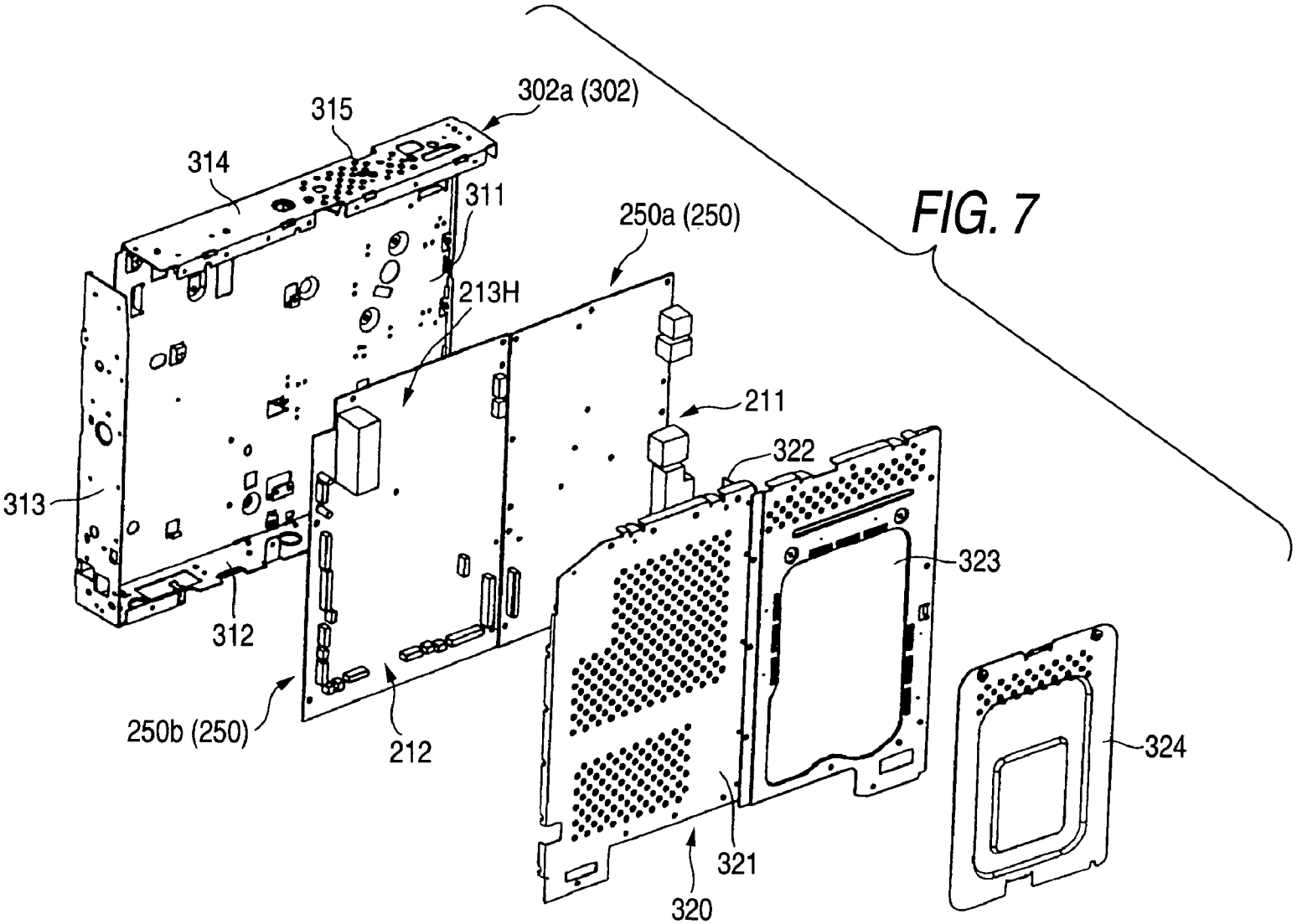
FIG. 7 is an exploded perspective view showing a board mounting structure on one main frame side.

In this embodiment, for example, as shown in FIGS. 5 and 7, one main frame 302*a* has a nearly rectangular flat plate portion 311 extending substantially vertically, and shield walls 312 to 314, for example, which are shaped like approximately a U figure for surrounding the flat plate portion 311 so that only one side end of the flat plate portion 311 is opened. The main frame 302*a* forms a shield chassis portion 310 shaped like approximately a box as a whole.

The shield walls 312 to 314 are formed by bending a plate piece molded so as to be integrated with the flat plate portion 311. A suitable number of air holes 315 are formed in the shield wall 314 formed at the upper portion of the shield chassis portion 310.

The first board 250*a* and the second board 250*b* are mounted on the shield chassis portion 310. An opening opposite to the flat plate portion 311 of the shield chassis portion 310 is covered with a shield cover 320.

Figure 9A:
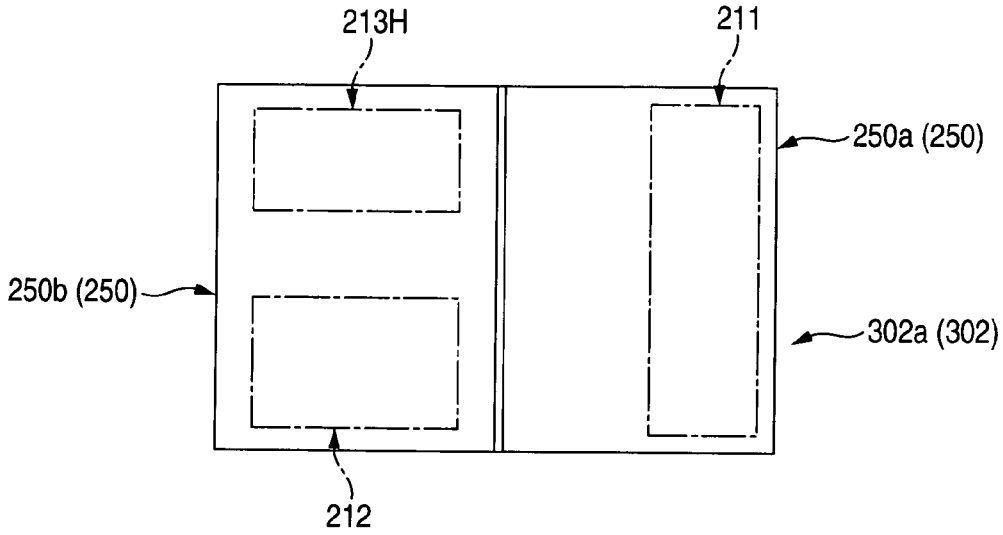
FIG. 9A is an explanatory view showing a circuit mounting example of a board on one main frame side.

In this embodiment, as shown in FIGS. 7 and 9A, for example, the image-processing circuit 211 is mounted in the first board 250*a* whereas the high-voltage power supply circuit 213H and the control circuit 212 are mounted in upper and lower portions of the second board 250*b* respectively.

In this embodiment, for example, the shield cover 320 is made of a zinc-plated steel plate. As shown in FIGS. 5 and 7, a partition wall 322 extending vertically is provided almost near the center of a plate-like cover body 321 so as to be erected. The shield cover 320 is partitioned into two regions by the partition wall 322. An opening 323 is formed in one of the two regions and provided with an opening/closing door 324 so that the opening/closing door 324 can be opened/closed.

In this case, the partition wall 322 is inserted in a gap portion between the first board 250*a* and the second board 250*b* when the shield cover 320 is put on the shield chassis portion 310. As a result, the shield chassis portion 310 is partitioned into two regions by the partition wall 322 so that the two regions are shielded respectively.

Figure 8:
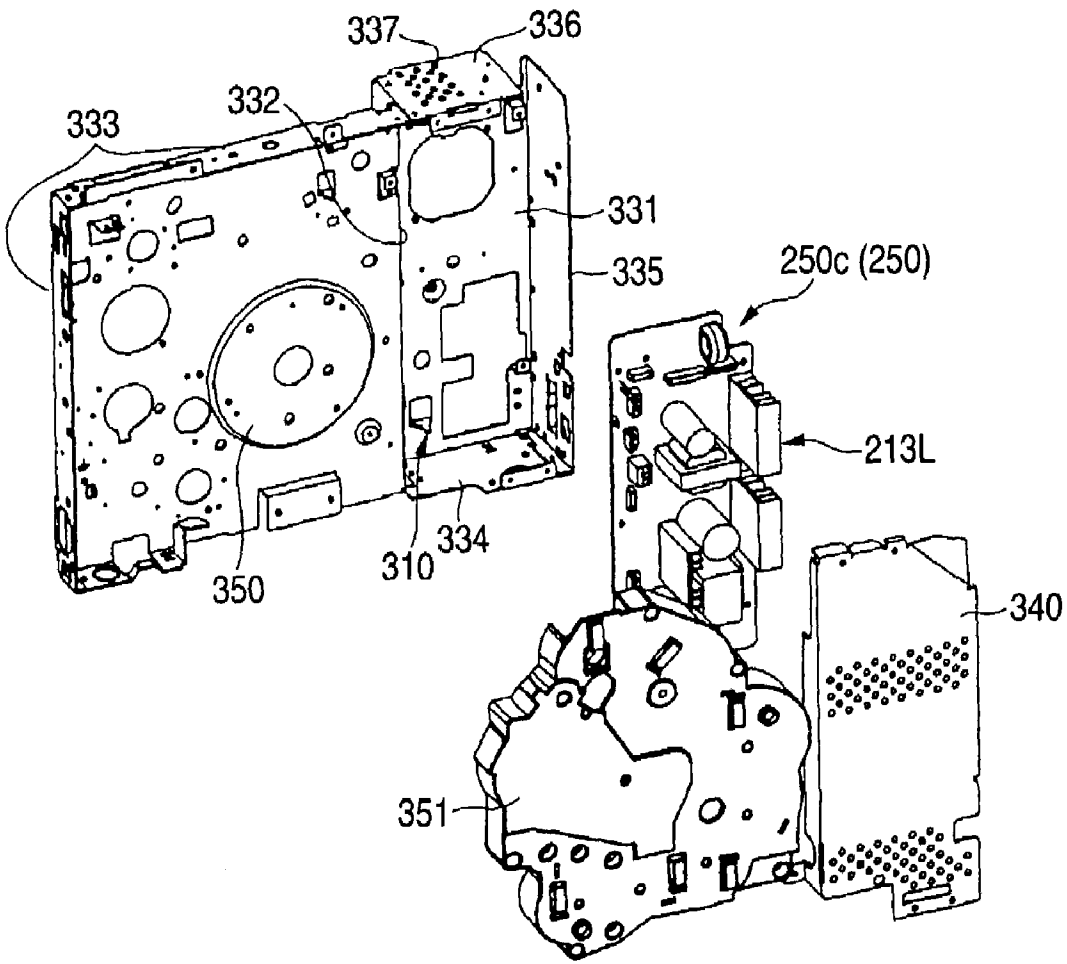
FIG. 8 is an exploded perspective view showing a board mounting structure on the other main frame side.

The other main frame 302*b* is made of the same material as that of one main frame 302*a*. For example, as shown in FIGS. 6 and 8, the main frame 302*b* has a stepped flat plate portion 331 extending substantially vertically and provided with a step portion 332 formed in the middle, a reinforcing flange portion 333 for surrounding upper and side portions of one region of the stepped flat plate portion 331, and shield walls 334 to 336 erected for surrounding three sides of the other region of the stepped flat plate portion 331 except the step portion 322. A portion corresponding to the other region of the stepped flat plate portion 331 is formed as a shield chassis portion 310 shaped like approximately a box.

Incidentally, air holes 337 are formed in the shield wall 336 formed at the upper portion of the shield chassis portion 310.

A third board 205*c* is mounted on the shield chassis portion 310. An opening of the third board 205*c* opposite to the shield chassis portion 310 is covered with a shield cover 340.

On the other hand, a drive motor 350 which is a drive source for driving the image-forming portion 120 (see FIG. 3) and the sheet carrying system is mounted in the main frame 302*b* except the shield chassis portion 310. A gear unit 351 is connected to the drive motor 350.

Figure 9B:
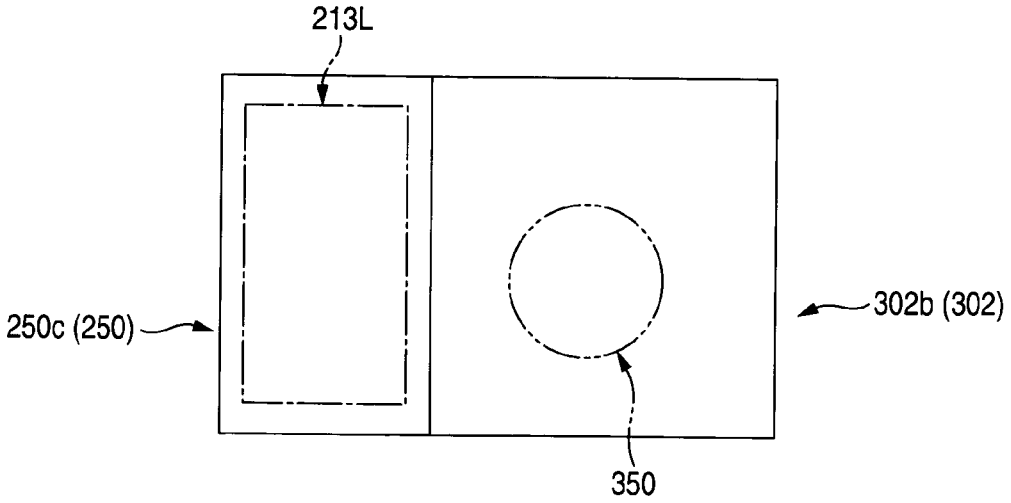
FIG. 9B is an explanatory view showing a circuit mounting example of a board on the other main frame side.

In this embodiment, as shown in FIGS. 8 and 9B, a low-voltage power supply circuit 213L is mounted in the third board 250*c*.

Hence, according to this embodiment, each of the boards 250 (250*a* and 250*b*) mounted with the image-processing circuit 211, the control circuit 212 and the power supply circuit 213 is mounted to any one of the shield chassis portions 310 formed in the main frames 302, directly or by fittings such as screws through brackets, spacers, washers, etc.

In this case, when the casing frame 300 is connected to the ground, the ground connection of the shield chassis portions 310 is ensured so that an EMI countermeasure taken for the boards 250 mounted on the shield chassis portions 310 becomes effective surely.

In this embodiment, because the shield chassis portions 310 are surrounded by the shield walls 312 to 314 and by the shield walls 334 to 336 respectively, the basic shielding effect for the boards 250 can be held.

Particularly in this embodiment, because the shield chassis portions 310 are covered with the shield covers 320 and 340 respectively, the shielding effect of the shield chassis portions 310 can be held more securely.

In this embodiment, because the air holes 315 and 337 are formed in part of the shield walls 314 and 336 of the shield chassis portions 310 respectively, the heat-radiating effect for the boards 250 can be held well.

In this embodiment, as shown in FIGS. 7, 8, 9A and 9B, the high-voltage power supply circuit 213H is disposed so as to be far from the drive motor 350. Accordingly, noise from the high-voltage power supply circuit 213H is prevented from having influence on the rotating operation of the drive motor 350, so that the rotating operation of the drive motor 350 can be kept stable.

In this embodiment, because the main circuit boards 250 are mounted in outer sides of the pair of main frames 302, it is unnecessary to keep a space for installing the main circuit boards 250 in the sheet passing region S (see FIG. 5) of the casing frame 300.

For this reason, the degree of freedom for a layout of the image-forming portion 120 (see FIG. 3) and the sheet carrying system in the casing frame 300 increases.

In this embodiment, the casing frame 300 is formed so that the pair of main frames 302 (302*a* and 302*b*) are disposed on the base frame 301 so as to be opposite each other. The method for producing the casing frame 300 can be selected suitably. For example, the method shown in FIG. 10 is a preferred producing method.

Figure 10:
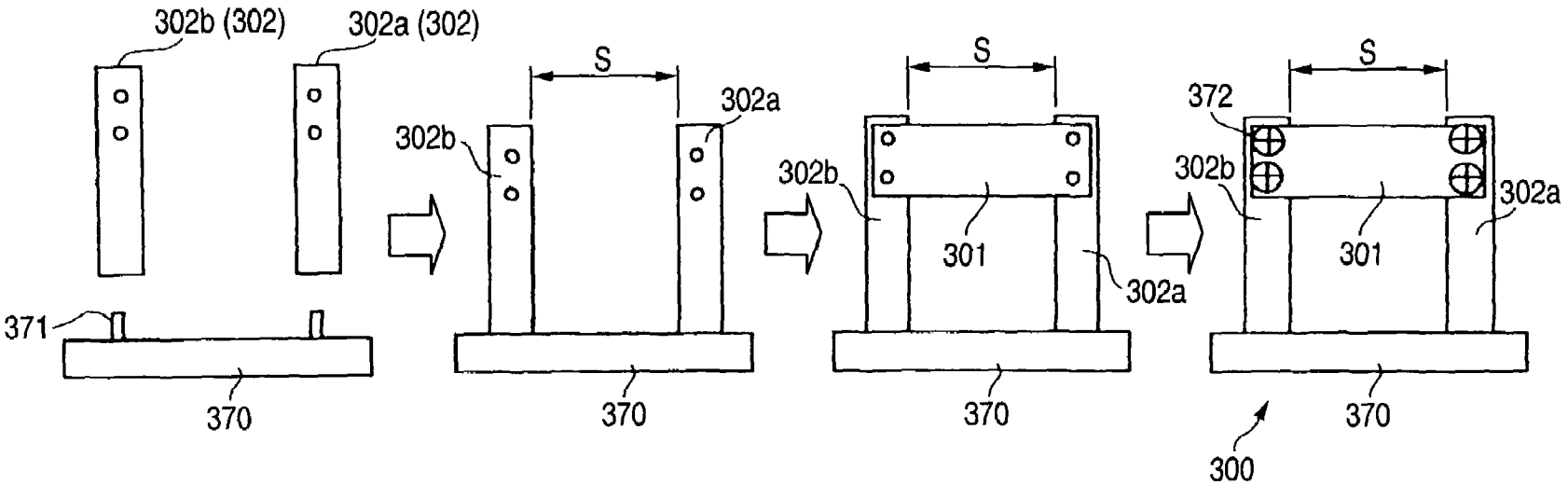
FIG. 10 is an explanatory view showing an example of the method for producing the frame structure according to Embodiment 1.

In FIG. 10, the pair of main frames 302 (302*a* and 302*b*) form box-like shield chassis portions 310 respectively. Each main frame 320 per se has stiffness.

Therefore, the casing frame 300 is produced as follows. First, the pair of main frames 302 (302*a* and 302*b*) provided with the shield chassis portions 310 formed in advance are attached to positioning portions 371 of a spacing jig 370 to thereby determine the distance (equivalent to the sheet passing region) S between the pair of main frames 302.

Then, the base frame 301 is attached and bridged between the main frames 302 and fixed by fittings 372 such as screws.

Though not shown in FIG. 10, the sub-frame 303 and the tie plate 304 are attached and fixed to the positioned main frames 302 successively.

In the producing method, for example, because the plate-like base frame 301 is attached to the main frames 302 having stiffness after the distance between the main frames 302 is decided by positioning, the dimensional accuracy and stiffness of the casing frame 300 as a whole can be ensured.

In this case, because the dimensional accuracy of the casing frame 300 does not depend on the dimensional accuracy of the base frame 301 per se, the base frame 301 can be replaced easily. When, for example, base frames 301 are prepared according to the sheet passing regions S corresponding to A4-size and A3-size machines respectively, the casing flame 300 corresponding to the kind of machine can be constructed easily and the type of the machine to be used can be changed easily.

Embodiment 2

Figure 12A:
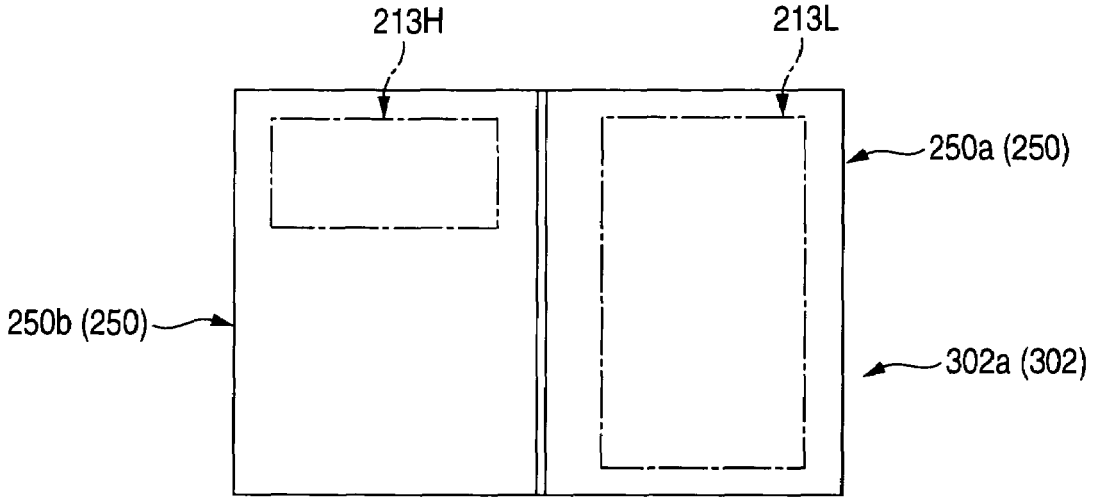
FIGS. 12A and 12B show a circuit mounting example of boards in Embodiment 2 of the invention, FIG. 12A being an explanatory view showing a circuit mounting example of a board on one main frame side, FIG. 12B being an explanatory view showing a circuit mounting example of a board on the other main frame side.
Figure 12B:
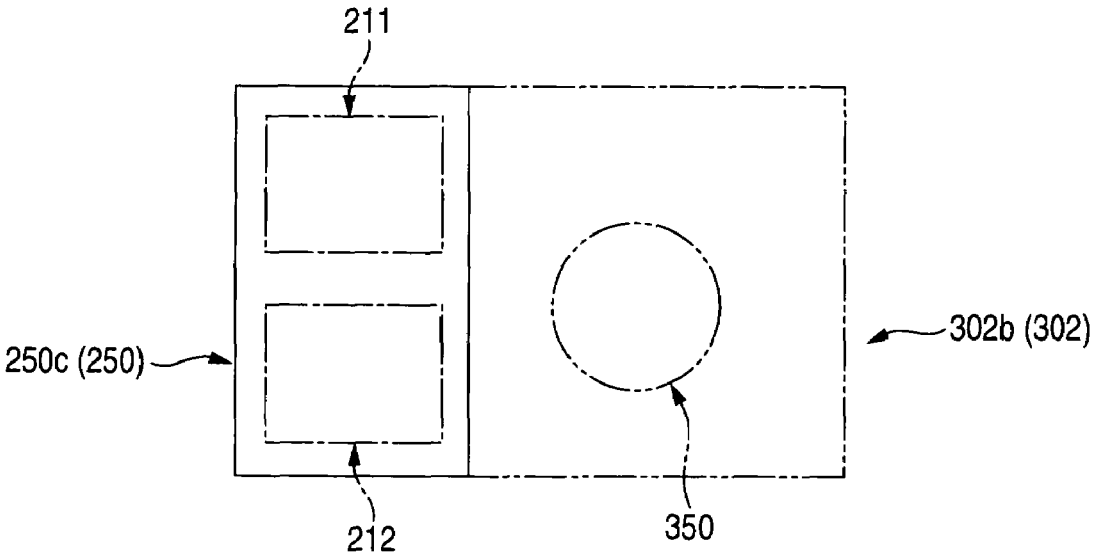

The basic configuration of the image-forming apparatus according to this embodiment is substantially the same as that according to Embodiment 1 except a layout of the main circuits for the boards 250 (250*a* and 250*b*) mounted on the shield chassises portions 310 of the pair of main frames 302 (302*a* and 302*b*) as shown in FIGS. 12A and 12B.

That is, in this embodiment, the power supply circuits 213 (the high-voltage power supply circuit 213H and the low-voltage power supply circuit 213L) are mounted in the first and second boards 250*a* and 250*b* respectively whereas the image-processing circuit 211 and the control circuit 212 are mounted in the third board 250*c*.

According to this embodiment, the power supply circuits 213 are disposed so as to be far from the image-processing circuit 211 and the control circuit 212. Accordingly, noise emitted from the power supply circuits 213 is prevented from having influence on the image-processing circuit 211 and the control circuit 212, so that the image-forming process can be kept stable.

As described above, in the image-forming apparatus according to the invention, at least part of a shield chassis portion is integrally formed in a casing frame per se so that a main circuit board is mounted on the shield chassis portion. Accordingly, when the casing frame per se is connected to the ground, the ground connection of the shield chassis portion can be positively ensured so that an EMI countermeasure taken for the main circuit board can be achieved effectively.

Furthermore, according to the invention, it is unnecessary to mount any separate shield chassis on the casing frame. Accordingly, the space and fittings for mounting the shield chassis can be dispensed with, so that reduction in size and cost of the apparatus can be attained.

Particularly in the invention, when the casing frame has a base frame, and one main frame or a plurality of main frames provided so as to be erected from the outside of a sheet passing region of the base frame so that a shield chassis portion is formed in at least one of the main frame or main frames, the degree of freedom for a layout in the casing frame can be increased and, at the same time, the kind of the machine can be changed easily when the position of each main frame is changed without the necessity of changing the layout of the board even under the demand that the sheet passing region should be changed.

In the frame structure of the image-forming apparatus according to the invention, when a required circuit board is simply mounted on the shield chassis portion formed in the casing frame per se, an EMI countermeasure taken for the board can be fulfilled effectively. Accordingly, an image-forming apparatus in which an EMI countermeasure for the board can be fulfilled effectively can be provided easily.

In the method for producing the frame structure of the image-forming apparatus according to the invention, when the frame structure is produced so that a pair of main frames provided with a pair of shield chassis portions formed therein are attached to a base frame so as to be opposite to each other, there is used a method in which the pair of main frames having stiffness are connected to each other by the base frame after the distance between the pair of main frames is decided by use of a simple spacing jig. Accordingly, the dimensional accuracy and stiffness of the casing frame as a whole can be ensured easily.

Furthermore, according to the producing method, because the method does not depend on the dimensional accuracy of the base frame, the base frame can be exchanged easily. Accordingly, the kind of the machine can be changed easily.

What is claimed is:

1. An image-forming apparatus comprising:

an image-forming portion comprising a photoconductor drum;

a casing frame enclosing the image-forming portion and forming a skeleton with a pair of main frames that are provided outside of a sheet passing region as to be opposite each other and a frame that is provided in a predetermined position between the pair of main frames;

a shield chassis portion formed so as to be partially integrated with the casing frame per se; and at least one board attached to the shield chassis portion and mounted with a power supply circuit, a control circuit and an image-processing circuit for permitting the image-forming portion to execute an image-forming process.

2. An image-forming apparatus according to claim 1, wherein the shield chassis portion is shaped like approximately a box in a manner so that shield walls are provided so as to be erected from all or part of a circumference of a corresponding region of the casing frame.

3. An image-forming apparatus according to claim 2, wherein the shield chassis portion is covered with a shield cover portion in the condition that the board is received in the shield chassis portion.

4. An image-forming apparatus according to claim 3, wherein the shield cover portion has a shield wall for partitioning the shield chassis portion.

5. An image-forming apparatus according to claim 1, wherein the shield chassis portion is formed on an outer side of the casing frame.

6. An image-forming apparatus according to claim 1, wherein the shield chassis portion has air holes provided in part of the shield chassis portion.

7. An image-forming apparatus according to claim 1, wherein the casing frame is formed so that at least part of the shield chassis portion is integrated with the casing frame; and the casing frame has a frame element which serves also as a support member for supporting at least a sheet carrying path member.

8. An image-forming apparatus according to claim 1, wherein the shield chassis portion is formed in at least one of the pair of main frames.

9. An image-forming apparatus according to claim 8, wherein the distance between the pair of main frames can be set variably.

10. An image-forming apparatus according to claim 8, wherein shield chassis portions are formed in the pair of main frames respectively so that a board mounted with a power supply circuit is received in the shield chassis portion of one of the main frames whereas a board mounted with a control circuit and an image-processing circuit is received in the shield chassis portion of the other main frame.

11. An image-forming apparatus according to claim 8, wherein a drive source for driving the image-forming portion is disposed in one of the main frames whereas a board mounted with at least a high-voltage power supply circuit is received in the shield chassis portion of the other main frame.

12. A frame structure of an image-forming apparatus, the frame structure comprising:

a casing frame enclosing an image forming portion and forming a skeleton with a pair of main frames that are provided outside of a sheet passing region as to be opposite each other and a frame that is provided in a predetermined position between the pair of main frames;

a shield chassis portion formed so that at least part of the shield chassis portion is integrated with the casing frame per se; and at least one board mounted in the shield chassis portion and mounted with a power supply circuit, a control circuit and an image-processing circuit for permitting the image-forming portion to execute an image-forming process, wherein the image-forming portion comprises a photoconductor drum.

13. A method of producing a frame structure of an image-forming apparatus according to claim 12, wherein at least part of shield chassis portions are formed so as to be integrated with the pair of main frames; and the method comprises the steps of:

disposing the pair of main frames provided with the chassis portions so as to be opposite to each other;

keeping the distance between the pair of main frames constant by a spacing jig; and connecting the pair of main frames to each other by the frame that is provided between the pair of main frames.

* * * * *